US006460479B1

(12) United States Patent
Lopaz et al.

(10) Patent No.: US 6,460,479 B1
(45) Date of Patent: Oct. 8, 2002

(54) CONVERTIBLE PROTECTIVE COVER/FLOATING TOWABLE AUXILIARY UNIT FOR A PERSONAL WATERCRAFT

(76) Inventors: Jerry W. Lopaz, 3551 W. 2000 North, West Point, UT (US) 84015; Randy Lopaz, 3702 S. 700 West, Riverdale, UT (US) 84405

( * ) Notice: Subject to any disclaimer, the term of this patent is extended or adjusted under 35 U.S.C. 154(b) by 0 days.

(21) Appl. No.: 09/169,162

(22) Filed: Oct. 8, 1998

(51) Int. Cl.[7] ..... B63B 17/02
(52) U.S. Cl. ..... 114/361; 114/242
(58) Field of Search ..... 114/361, 342, 114/349, 350, 55.5, 55.53, 352

(56) References Cited

U.S. PATENT DOCUMENTS 3,107,369 A * 10/1963 Zijlstra ..... 114/361
5,119,752 A * 6/1992 Doherty ..... 114/55.5
5,643,020 A * 7/1997 Harris ..... 440/31
5,651,706 A * 7/1997 Kasper ..... 114/354
5,660,137 A * 8/1997 Manley ..... 114/361
5,791,280 A * 8/1998 Egan et al. ..... 114/361
D408,005 S * 4/1999 Barnes ..... D12/317
6,125,784 A * 10/2000 Rehel et al. ..... 114/361
6,213,046 B1 * 4/2001 Lawson ..... 114/361

* cited by examiner

*Primary Examiner*—Sherman Basinger
(74) *Attorney, Agent, or Firm*—Thompson E. Fehr

(57) ABSTRACT

A convertible cover for protecting a personal watercraft and increasing the carrying capacity of the personal watercraft. The convertible cover consists primarily of a watertight, unitary hull which, when placed on the personal watercraft, encloses substantially all of the upper portion of the personal watercraft to protect the part of the personal watercraft above the hull and the billage seam. To increase the carrying capacity of the personal watercraft, the convertible cover can be placed in the water and towed behind the personal watercraft. Cargo or a seat can be placed within the hull.

55 Claims, 2 Drawing Sheets

CONVERTIBLE PROTECTIVE COVER/ FLOATING TOWABLE AUXILIARY UNIT FOR A PERSONAL WATERCRAFT

BACKGROUND OF THE INVENTION

1. Field of the Invention

This invention relates to a device for covering a personal watercraft, which—when inverted—floats and can be towed by the personal watercraft.

2. Description of the Related Art

Two patents which claim covers for boats are U.S. Pat. No. 3,734,047 and U.S. Pat. No. 4,223,414.

However, only the cover of U.S. Pat. No. 3,734,047 can be detached and inverted for use as a floating transportation unit. The cover of U.S. Pat. No. 4,223,414 rotates away from the boat but remains permanently attached to a support structure, which is only disclosed to be a trailer.

The cover of U.S. Pat. No. 3,734,047, though, covers only a relatively small portion of the boat and usually remains attached to the boat while the boat is being sailed.

Conversely, U.S. Pat. No. 5,119,752 covers a floating transportation unit that can be pulled by a personal watercraft; but, although there is a permanently attached, hinged cover for the floating transportation unit, the invention includes no cover for the personal watercraft. And U.S. Pat. No. 5,357,891 applies to a floating transportation unit that can be towed by a personal watercraft but has no cover—either for the personal watercraft or for the floating transportation unit.

And U.S. Pat. No. 4,554,884 includes a cover which covers only the cockpit of the watercraft and which can be raised above the cockpit or removed from the watercraft entirely and used to support a tent. There is, however, no indication that the cover floats.

Four patents—U.S. Pat. Nos. 4,366,769; 4,718,587; 4,790,256; and 4,841,900—apply to containers which can be converted into boats. The boats thereby created have, however, hulls composed of several different pieces that contact the water. Moreover, the containers are not intended to protect watercraft. It would, in fact, be necessary to lift a watercraft into such containers even if the containers were large enough to hold the watercraft.

U.S. Pat. Nos. 4,474,131 and 5,383,702 concern canopies for vehicles, such as those which are utilized to cover the bed of a pick-up truck in order to create a "camper." Again, though, the boats created from these canopies have hulls composed of several different pieces that contact the water. Furthermore, such canopies are not disclosed as being for use on watercraft; and the latter of the two patents even expressly declares that the canopy is for a pick-up truck.

Finally, although the hull of the boat created from the box of U.S. Pat. No. 5,645,010 is unitary, such boat is composed of two primary parts. And, as was the case with respect to the containers discussed previously, the box could protect a watercraft only if the watercraft were lifted into the box.

SUMMARY OF THE INVENTION

The present invention is a cover which substantially covers the upper portion of a personal watercraft and which can be inverted to create a floating transportation unit having a unitary hull.

DESCRIPTION OF THE PREFERRED EMBODIMENT

Personal watercraft 1 have become very popular. They do, however, have two disadvantages. First, as their name suggests, personal watercraft 1 have very limited carrying capacity. And, second, the upper portion of a personal watercraft 1, i.e., the part of the personal watercraft 1 above the hull 2 and the billage seam 3, is particularly subject to damage. For example, when the personal watercraft 1 is being towed on a wheel-mounted trailer, small rocks can be thrown against the watercraft 1; and when the personal watercraft 1 is stored outside, the sun and other environmental factors, such as rain and snow, can degrade the personal watercraft 1.

The present invention is directed toward eliminating both of these disadvantages. For protecting the personal watercraft 1, as depicted in FIG. 1, the Convertible Cover 4 is placed upon the billage seam 3 of the personal watercraft 1.

Figure 1:
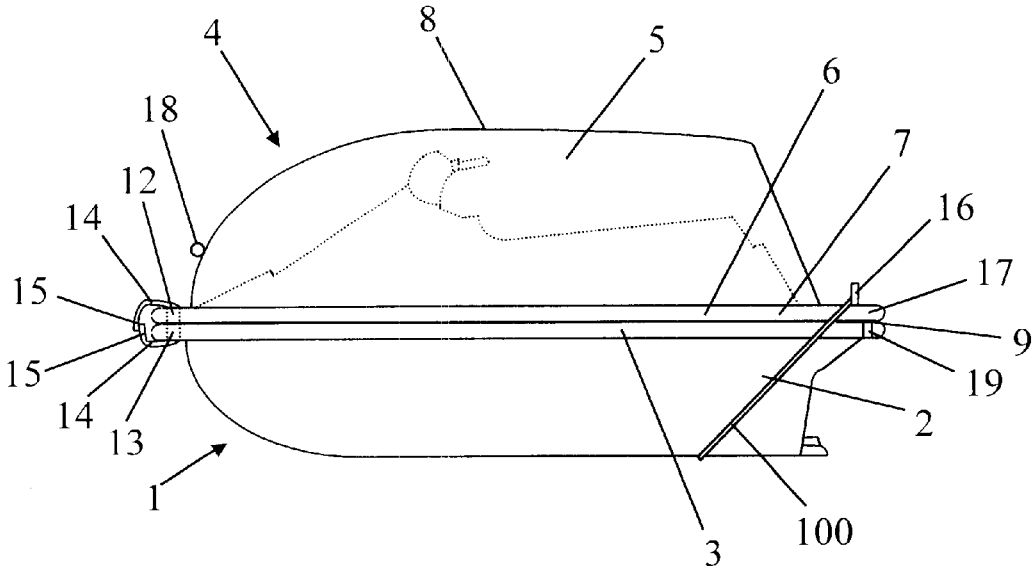
FIG. 1 is a lateral view of the convertible cover attached to a personal watercraft.
Figure 2:
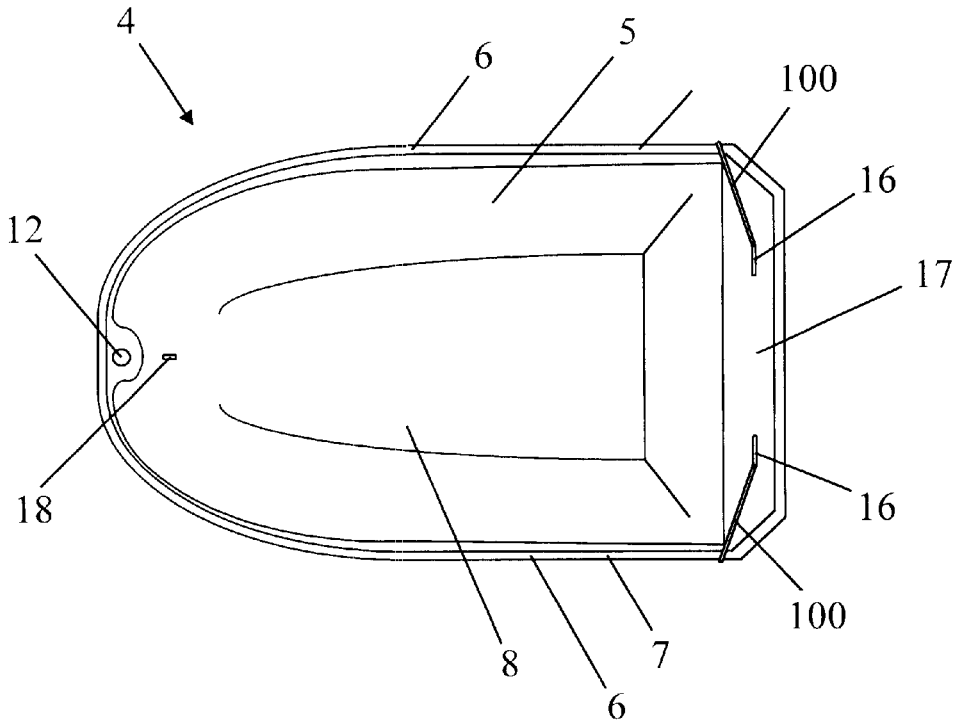
FIG. 2 is a view from above the convertible cover when the convertible cover has been attached to a personal watercraft.

The Convertible Cover 4 is preferably generally formed, as can be seen in FIG. 1 and FIG. 2, with a hull 5 in the traditional shape for the hull of a boat, and the hull 5 is watertight so that the Convertible Cover 4 will float. The upper end 6 of the hull 5 of the Convertible Cover 4 is shaped substantially the same as is the billage seam 3 of the personal watercraft 1 so that the rim 7 of the hull 5 of the Convertible Cover 4 can, when the base 8 of the hull 5 is placed above the rim 7, rest upon the billage seam 3. And the hull 5 is constructed in such a size that when the Convertible Cover 4 has been placed on the billage seam 3 of the personal watercraft 1, the Convertible Cover 4 encloses substantially all of the upper portion of the personal watercraft 1.

Preferably, in order to minimize the possibility of damaging the billage seam 3, a soft strip 9, preferably a tube constructed from rubberized foam, is attached to the rim 7 of the Convertible Cover 4 so that the soft strip 9 will be located substantially between the rim 7 of the Convertible Cover 4 and the billage seam 3 of the personal watercraft I when the Convertible Cover 4 has been placed, as a cover, upon the personal watercraft 1.

Figure 3:
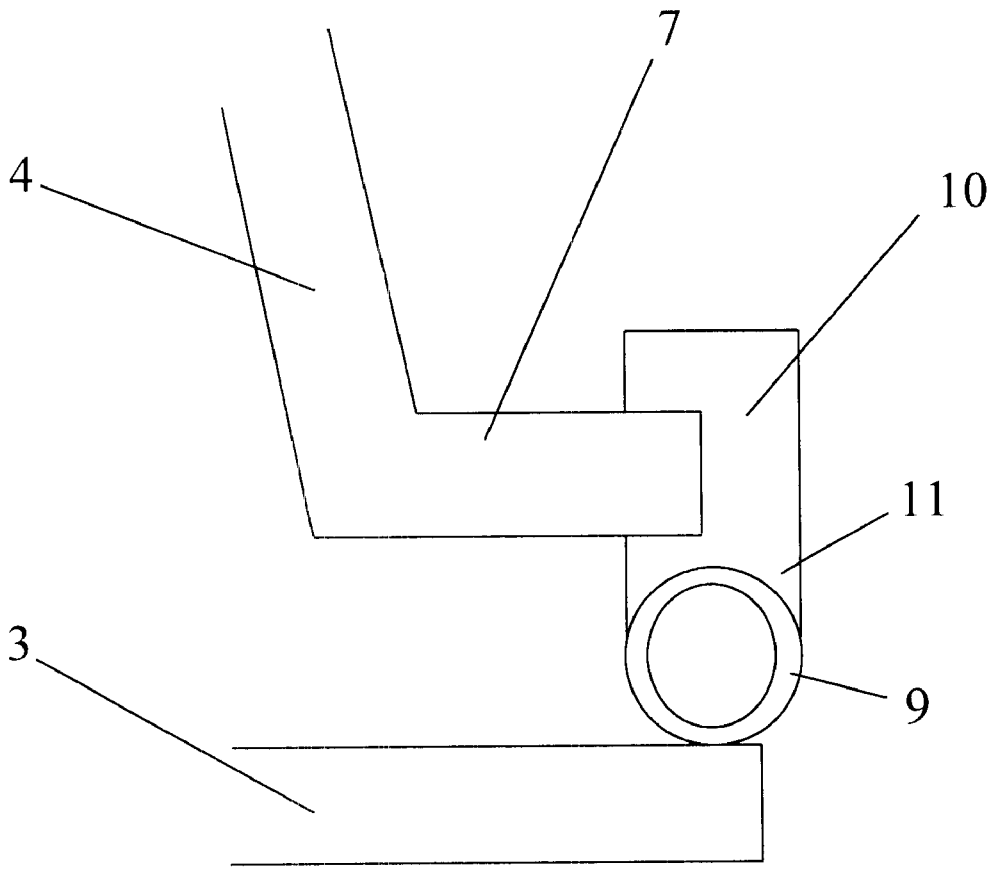
FIG. 3 shows a vinyl-covered metal locking trim attached to the rim of the convertible cover.

The preferable means for attaching the soft strip 9 to the rim 7 is, as illustrated in FIG. 3, to attach a vinyl-covered metal locking trim 10 to the rim 7 and to have the soft strip 9 attached to the top 11 of the metal locking trim 10.

Also preferably, the hull 5, to maximize simplicity and structural integrity, will be a unitary structure.

Again preferably, the Convertible Cover 4 will be releasably connected to the personal watercraft 1. In the preferred manner for accomplishing this releasable connection, an aperture 12 is located in the rim 7 of the Convertible Cover 4 at such a position that the aperture 12 will be approximately aligned with an aperture 13 in the billage seam 3 of the personal watercraft 1 when the rim 7 has been placed on the billage seam 3. A nylon strap 14 is then placed through aperture 12 and aperture 13 and then the ends 15 of the nylon strap 14 are releasably connected to each other by any means that is well known in the art, such as tying or using a locking button and a lug (commonly termed "snaps") or utilizing VELCRO® fasteners. Additionally it is preferred to have one or more handles 16 attached to the rear 17 of the rim 7 so that each end of a bungee cord 100 can be releasably connected to such handle 16 or handles 16 with the intermediate portion of the bungee cord 100 passing around either the personal watercraft 1 or a trailer (not illustrated) on which the personal watercraft 1 has been placed.

To increase the carrying capacity of the personal watercraft 1, the Convertible Cover 4 is removed from the personal watercraft 1 and inverted. Since the Convertible Cover 4 primarily consist of a hull 5 in the traditional shape of the hull of a boat and since the hull 5 is watertight so that the Convertible Cover 4 will float, cargo or a seat (not illustrated) can be placed with the hull 5; and the Convertible Cover 4 can function as a floating transportation unit and be towed by the personal watercraft 1 through the water.

A towing mechanism, such as a tow line (not illustrated) or, preferably, a tow bar (not illustrated)—to preclude the Convertible Cover 4 from running into the rear of the personal watercraft 1 when the personal watercraft 1 stops during the process of towing the Convertible Cover 4, can be connected to a tow loop 18 that is preferably attached to the hull 5 of the Convertible Cover 4 near the front of the Convertible Cover 4 sufficiently below the rim 7 (preferably eight to ten inches below the rim 7) that the towing of the Convertible Cover 4 by the personal watercraft 1 does not force the rim 7 so close to the surface of the water that water may enter the Convertible Cover 4. The tow loop or tow bar is, of course, also attached to the personal watercraft 1. An example of a point for attachment of the tow line (not illustrated) to the personal watercraft 1 is an aperture 19 generally in the rear portion 17 of the billage seam 3 of the personal watercraft 1.

We claim:

1. A convertible cover for a personal watercraft, which comprises:

a watertight, unitary hull having a rim and having the upper end of said hull shaped substantially the same as is the billage seam of a personal watercraft and having said hull of such size that said hull encloses substantially all of the upper portion of a personal watercraft when the convertible cover has been placed on the billage seam of the personal watercraft.

2. The convertible cover for a personal watercraft as recited in claim 1, wherein:

said hull is formed in the traditional shape for the hull of a boat.

3. The convertible cover for a personal watercraft as recited in claim 2, further comprising:

a soft strip attached to the rim of said convertible cover so that said soft strip will be located substantially between the rim of the convertible cover and the billage seam of a personal watercraft.

4. The convertible cover for a personal watercraft as recited in claim 3, wherein:

said soft strip is a tube constructed from rubberized foam.

5. The convertible cover for a personal watercraft as recited in claim 3, further comprising:

a means for attaching a towing mechanism to the convertible cover.

6. The convertible cover for a personal watercraft as recited in claim 5, wherein:

the means for attaching a towing mechanism to the convertible cover comprises a loop attached to the hull of said convertible cover near the front of said convertible cover sufficiently below the rim that the towing of said convertible cover by the personal watercraft does not force the rim so close to the surface of the water that water may enter said convertible cover.

7. The convertible cover for a personal watercraft as recited in claim 5, wherein:

said soft strip is a tube constructed from rubberized foam.

8. The convertible cover for a personal watercraft as recited in claim 7, wherein:

the means for attaching a towing mechanism to the convertible cover comprises a loop attached to the hull of said convertible cover near the front of said convertible cover sufficiently below the rim that the towing of said convertible cover by the personal watercraft does not force the rim so close to the surface of the water that water may enter said convertible cover.

9. The convertible cover for a personal watercraft as recited in claim 2, further comprising:

a means for releasably connecting said convertible cover to a personal watercraft.

10. The convertible cover for a personal watercraft as recited in claim 9, further comprising:

a soft strip attached to the rim of said convertible cover so that said soft strip will be located substantially between the rim of the convertible cover and the billage seam of a personal watercraft.

11. The convertible cover for a personal watercraft as recited in claim 10, wherein:

said soft strip is a tube constructed from rubberized foam.

12. The convertible cover for a personal watercraft as recited in claim 10, wherein:

the means for releasably connecting the convertible cover to a personal watercraft comprises an aperture in the rim of the convertible cover at such a position that said aperture will be approximately aligned with an aperture in the billage seam of the personal watercraft when the rim has been placed on the billage seam, a nylon strap to be placed through the aperture in the rim and the aperture in the billage seam before having the ends of the nylon strap releasably connected to each other, a bungee cord, and one or more handles attached to the rear of the rim so that each end of said bungee cord can be releasably connected to said handle or handles with the intermediate portion of the bungee cord available to pass around either the personal watercraft or a trailer on which the personal watercraft may be placed.

13. The convertible cover for a personal watercraft as recited in claim 12, wherein:

said soft strip is a tube constructed from rubberized foam.

14. The convertible cover for a personal watercraft as recited in claim 10, further comprising:

a means for attaching a towing mechanism to the convertible cover.

15. The convertible cover for a personal watercraft as recited in claim 14, wherein:

the means for attaching a towing mechanism to the convertible cover comprises a loop attached to the hull of said convertible cover near the front of said convertible cover sufficiently below the rim that the towing of said convertible cover by the personal watercraft does not force the rim so close to the surface of the water that water may enter said convertible cover.

16. The convertible cover for a personal watercraft as recited in claim 14, wherein:

said soft strip is a tube constructed from rubberized foam.

17. The convertible cover for a personal watercraft as recited in claim 16, wherein:

the means for attaching a towing mechanism to the convertible cover comprises a loop attached to the hull of said convertible cover near the front of said convertible cover sufficiently below the rim that the towing of said convertible cover by the personal watercraft does not force the rim so close to the surface of the water that water may enter said convertible cover.

18. The convertible cover for a personal watercraft as recited in claim 14, wherein:

the means for releasably connecting the convertible cover to a personal watercraft comprises an aperture in the rim of the convertible cover at such a position that said aperture will be approximately aligned with an aperture in the billage seam of the personal watercraft when the rim has been placed on the billage seam, a nylon strap to be placed through the aperture in the rim and the aperture in the billage seam before having the ends of the nylon strap releasably connected to each other, a bungee cord, and one or more handles attached to the rear of the rim so that each end of said bungee cord can be releasably connected to said handle or handles with the intermediate portion of the bungee cord available to pass around either the personal watercraft or a trailer on which the personal watercraft may be placed.

19. The convertible cover for a personal watercraft as recited in claim 18, wherein:

the means for attaching a towing mechanism to the convertible cover comprises a loop attached to the hull of said convertible cover near the front of said convertible cover sufficiently below the rim that the towing of said convertible cover by the personal watercraft does not force the rim so close to the surface of the water that water may enter said convertible cover.

20. The convertible cover for a personal watercraft as recited in claim 18, wherein:

said soft strip is a tube constructed from rubberized foam.

21. The convertible cover for a personal watercraft as recited in claim 20, wherein:

the means for attaching a towing mechanism to the convertible cover comprises a loop attached to the hull of said convertible cover near the front of said convertible cover sufficiently below the rim that the towing of said convertible cover by the personal watercraft does not force the rim so close to the surface of the water that water may enter said convertible cover.

22. The convertible cover for a personal watercraft as recited in claim 9, wherein:

the means for releasably connecting the convertible cover to a personal watercraft comprises an aperture in the rim of the convertible water cover at such a position that said aperture will be approximately aligned with an aperture in the billage seam of the personal watercraft when the rim has been placed on the billage seam, a nylon strap to be placed through the aperture in the rim and the aperture in the billage seam before having the ends of the nylon strap releasably connected to each other, a bungee cord, and one or more handles attached to the rear of the rim so that each end of said bungee cord can be releasably connected to said handle or handles with the intermediate portion of the bungee cord available to pass around either the personal watercraft or a trailer on which the personal watercraft may be placed.

23. The convertible cover for a personal watercraft as recited in claim 9, further comprising:

a means for attaching a towing mechanism to the convertible cover.

24. The convertible cover for a personal watercraft as recited in claim 23, wherein:

the means for attaching a towing mechanism to the convertible cover comprises a loop attached to the hull of said convertible cover near the front of said convertible cover sufficiently below the rim that the towing of said convertible cover by the personal watercraft does not force the rim so close to the surface of the water that water may enter said convertible cover.

25. The convertible cover for a personal watercraft as recited in claim 23, wherein:

the means for releasably connecting the convertible cover to a personal watercraft comprises an aperture in the rim of the convertible cover at such a position that said aperture will be approximately aligned with an aperture in the billage seam of the personal watercraft when the rim has been placed on the billage seam, a nylon strap to be placed through the aperture in the rim and the aperture in the billage seam before having the ends of the nylon strap releasably connected to each other, a bungee cord, and one or more handles attached to the rear of the rim so that each end of said bungee cord can be releasably connected to said handle or handles with the intermediate portion of the bungee cord available to pass around either the personal watercraft or a trailer on which the personal watercraft may be placed.

26. The convertible cover for a personal watercraft as recited in claim 25, wherein:

the means for attaching a towing mechanism to the convertible cover comprises a loop attached to the hull of said convertible cover near the front of said convertible cover sufficiently below the rim that the towing of said convertible cover by the personal watercraft does not force the rim so close to the surface of the water that water may enter said convertible cover.

27. The convertible cover for a personal watercraft as recited in claim 2, further comprising:

a means for attaching a towing mechanism to the convertible cover.

28. The convertible cover for a personal watercraft as recited in claim 27, wherein:

the means for attaching a towing mechanism to the convertible cover comprises a loop attached to the hull of said convertible cover near the front of said convertible cover sufficiently below the rim that the towing of said convertible cover by the personal watercraft does not force the rim so close to the surface of the water that water may enter said convertible cover.

29. The convertible cover for a personal watercraft as recited in claim 1, further comprising:

a means for releasably connecting said convertible cover to a personal watercraft.

30. The convertible cover for a personal watercraft as recited in claim 29, wherein:

the means for releasably connecting the convertible cover to a personal watercraft comprises an aperture in the rim of the convertible cover at such a position that said aperture will be approximately aligned with an aperture in the billage seam of the personal watercraft when the rim has been placed on the billage seam, a nylon strap to be placed through the aperture in the rim and the aperture in the billage seam before having the ends of the nylon strap releasably connected to each other, a bungee cord, and one or more handles attached to the rear of the rim so that each end of said bungee cord can be releasably connected to said handle or handles with the intermediate portion of the bungee cord available to pass around either the personal watercraft or a trailer on which the personal watercraft may be placed.

31. The convertible cover for a personal watercraft as recited in claim 29, further comprising:

a soft strip attached to the rim of said convertible cover so that said soft strip will be located substantially between the rim of the convertible cover and the billage seam of a personal watercraft.

32. The convertible cover for a personal watercraft as recited in claim 31, wherein:

said soft strip is a tube constructed from rubberized foam.

33. The convertible cover for a personal watercraft as recited in claim 31, wherein:

the means for releasably connecting the convertible cover to a personal watercraft comprises an aperture in the rim of the convertible cover at such a position that said aperture will be approximately aligned with an aperture in the billage seam of the personal watercraft when the rim has been placed on the billage seam, a nylon strap to be placed through the aperture in the rim and the aperture in the billage seam before having the ends of the nylon strap releasably connected to each other, a bungee cord, and one or more handles attached to the rear of the rim so that each end of said bungee cord can be releasably connected to said handle or handles with the intermediate portion of the bungee cord available to pass around either the personal watercraft or a trailer on which the personal watercraft may be placed.

34. The convertible cover for a personal watercraft as recited in claim 33, wherein:

said soft strip is a tube constructed from rubberized foam.

35. The convertible cover for a personal watercraft as recited in claim 31, further comprising:

a means for attaching a towing mechanism to the convertible cover.

36. The convertible cover for a personal watercraft as recited in claim 35, wherein:

the means for attaching a towing mechanism to the convertible cover comprises a loop attached to the hull of said convertible cover near the front of said convertible cover sufficiently below the rim that the towing of said convertible cover by the personal watercraft does not force the rim so close to the surface of the water that water may enter said convertible cover.

37. The convertible cover for a personal. watercraft as recited in claim 35, wherein:

said soft strip is a tube constructed from rubberized foam.

38. The convertible cover for a personal watercraft as recited in claim 37, wherein:

the means for attaching a towing mechanism to the convertible cover comprises a loop attached to the hull of said convertible cover near the front of said convertible cover sufficiently below the rim that the towing of said convertible cover by the personal watercraft does not force the rim so close to the surface of the water that water may enter said convertible cover.

39. The convertible cover for a personal watercraft as recited in claim 35, wherein:

the means for releasably connecting the convertible cover to a personal watercraft comprises an aperture in the rim of the convertible cover at such a position that said aperture will be approximately aligned with an aperture in the billage seam of the personal watercraft when the rim has been placed on the billage seam, a nylon strap to be placed through the aperture in the rim and the aperture in the billage seam before having the ends of the nylon strap releasably connected to each other, a bungee cord, and one or more handles attached to the rear of the rim so that each end of said bungee cord can be releasably connected to said handle or handles with the intermediate portion of the bungee cord available to pass around either the personal watercraft or a trailer on which the personal watercraft may be placed.

40. The convertible cover for a personal watercraft as recited in claim 39, wherein:

the means for attaching a towing mechanism to the convertible cover comprises a loop attached to the hull of said convertible cover near the front of said convertible cover sufficiently below the rim that the towing of said convertible cover by the personal watercraft does not force the rim so close to the surface of the water that water may enter said convertible cover.

41. The convertible cover for a personal watercraft as recited in claim 39, wherein:

said soft strip is a tube constructed from rubberized foam.

42. The convertible cover for a personal watercraft as recited in claim 41, wherein:

the means for attaching a towing mechanism to the convertible cover comprises a loop attached to the hull of said convertible cover near the front of said convertible cover sufficiently below the rim that the towing of said convertible cover by the personal watercraft does not force the rim so close to the surface of the water that water may enter said convertible cover.

43. The convertible cover for a personal watercraft as recited in claim 29, further comprising:

a means for attaching a towing mechanism to the convertible cover.

44. The convertible cover for a personal watercraft as recited in claim 43, wherein:

the means for attaching a towing mechanism to the convertible cover comprises a loop attached to the hull of said convertible cover near the front of said convertible cover sufficiently below the rim that the towing of said convertible cover by the personal watercraft does not force the rim so close to the surface of the water that water may enter said convertible cover.

45. The convertible cover for a personal watercraft as recited in claim 43, wherein:

the means for releasably connecting the convertible cover to a personal watercraft comprises an aperture in the rim of the convertible cover at such a position that said aperture will be approximately aligned with an aperture in the billage seam of the personal watercraft when the rim has been placed on the billage seam, a nylon strap to be placed through the aperture in the rim and the aperture in the billage seam before having the ends of the nylon strap releasably connected to each other, a bungee cord, and one or more handles attached to the rear of the rim so that each end of said bungee cord can be releasably connected to said handle or handles with the intermediate portion of the bungee cord available to pass around either the personal watercraft or a trailer on which the personal watercraft may be placed.

46. The convertible cover for a personal watercraft as recited in claim 45, wherein:

the means for attaching a towing mechanism to the convertible cover comprises a loop attached to the hull of said convertible cover near the front of said convertible cover sufficiently below the rim that the towing of said convertible cover by the personal watercraft does not force the rim so close to the surface of the water that water may enter said convertible cover.

47. The convertible cover for a personal watercraft as recited in claim 1, further comprising:

a soft strip attached to the rim of said convertible cover so that said soft strip will be located substantially between the rim of the convertible cover and the billage seam of a personal watercraft.

48. The convertible cover for a personal watercraft as recited in claim 47, wherein:

said soft strip is a tube constructed from rubberized foam.

49. The convertible cover for a personal watercraft as recited in claim 47, further comprising:

a means for attaching a towing mechanism to the convertible cover.

50. The convertible cover for a personal watercraft as recited in claim 49, wherein:

the means for attaching a towing mechanism to the convertible cover comprises a loop attached to the hull of said convertible cover near the front of said convertible cover sufficiently below the rim that the towing of said convertible cover by the personal watercraft does not force the rim so close to the surface of the water that water may enter said convertible cover.

51. The convertible cover for a personal watercraft as recited in claim 49, wherein:

said soft strip is a tube constructed from rubberized foam.

52. The convertible cover for a personal watercraft as recited in claim 51, wherein:

the means for attaching a towing mechanism to the convertible cover comprises a loop attached to the hull of said convertible cover near the front of said convertible cover sufficiently below the rim that the towing of said convertible cover by the personal watercraft does not force the rim so close to the surface of the water that water may enter said convertible cover.

53. The convertible cover for a personal watercraft as recited in claim 1, further comprising:

a means for attaching a towing mechanism to the convertible cover.

54. The convertible cover for a personal watercraft as recited in claim 53, wherein:

the means for attaching a towing mechanism to the convertible cover comprises a loop attached to the hull of said convertible cover near the front of said convertible cover sufficiently below the rim that the towing of said convertible cover by the personal watercraft does not force the rim so close to the surface of the water that water may enter said convertible cover.

55. A process for protecting a personal watercraft and increasing the carrying capacity of the personal watercraft, which comprises:

placing on a personal watercraft a convertible cover which convertible cover comprises a watertight, unitary hull having the upper end of said hull shaped substantially the same as is the billage seam of a personal watercraft and having said hull of such size that said hull encloses substantially all of the upper portion of a personal watercraft when the convertible cover has been placed on the billage seam of the personal watercraft.

* * * * *